United States Patent [19]

Ellingson

[11] Patent Number: 4,537,002

[45] Date of Patent: Aug. 27, 1985

[54] GLAZING BEAD STRUCTURE

[75] Inventor: Robert T. Ellingson, Lakeville, Minn.

[73] Assignee: Reese Enterprises, Inc., Rosemount, Minn.

[21] Appl. No.: 530,478

[22] Filed: Sep. 8, 1983

[51] Int. Cl.[3] ..... E06B 7/16

[52] U.S. Cl. ..... 52/403; 52/235; 49/489

[58] Field of Search ..... 52/400, 403, 309.4, 52/309.6, 309.8, 309.1, 393, 397, 235; 49/489, 498

[56] References Cited

U.S. PATENT DOCUMENTS

| | | | |
|---|---|---|---|
| 3,233,381 | 2/1966 | Von Wedel | 52/403 X |
| 3,448,543 | 6/1969 | Multer | 49/489 X |
| 3,501,868 | 3/1970 | Ganzinotti | 49/489 X |
| 3,555,735 | 1/1971 | Weikert | 52/403 X |
| 3,656,260 | 4/1972 | Weaver | 49/489 |
| 4,214,415 | 7/1980 | Sukolics | 52/403 X |
| 4,267,673 | 5/1981 | Coulston | 52/403 X |

FOREIGN PATENT DOCUMENTS

| | | | |
|---|---|---|---|
| 6801994 | 8/1969 | Netherlands | 52/235 |

*Primary Examiner*—J. Karl Bell
*Attorney, Agent, or Firm*—Leo Gregory

[57] ABSTRACT

This invention relates to a glazing or insulating bead useable particularly with large commercial type glass building walls wherein the building wall frame structure embodies window frames, each frame has channels to receive a window pane, each channel has a pair of small opposed facing longitudinal sockets at its entrance and the glazing bead herein is particularly adapted to be non-stretchable in being disposed into one of the sockets either by being pulled thereinto or may be pushed laterally thereinto, in either instance, the glazing bead is particularly adapted not to be dislodged by the subsequent installation of a window pane.

4 Claims, 6 Drawing Figures

FIG. 4
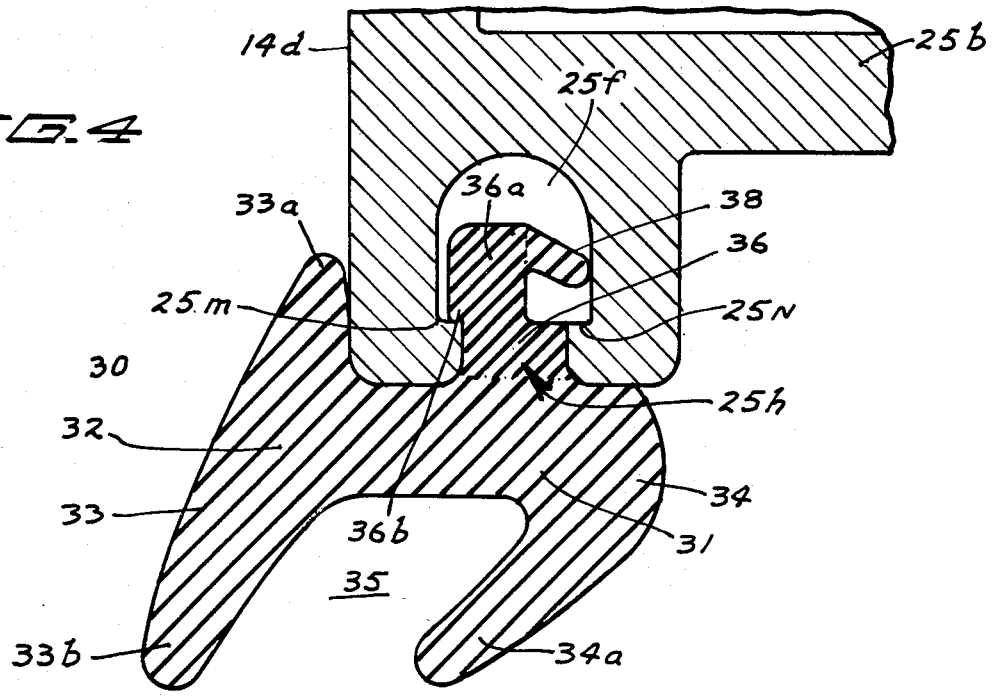
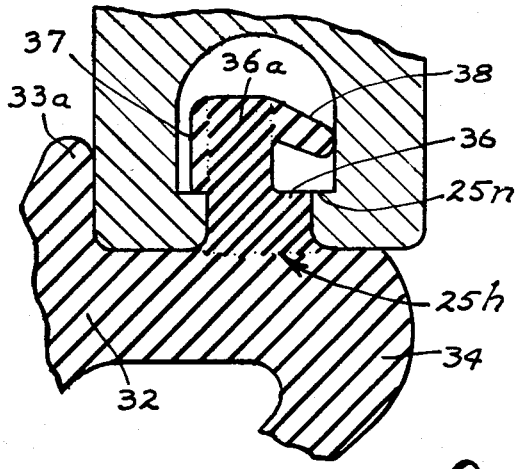
FIG. 6
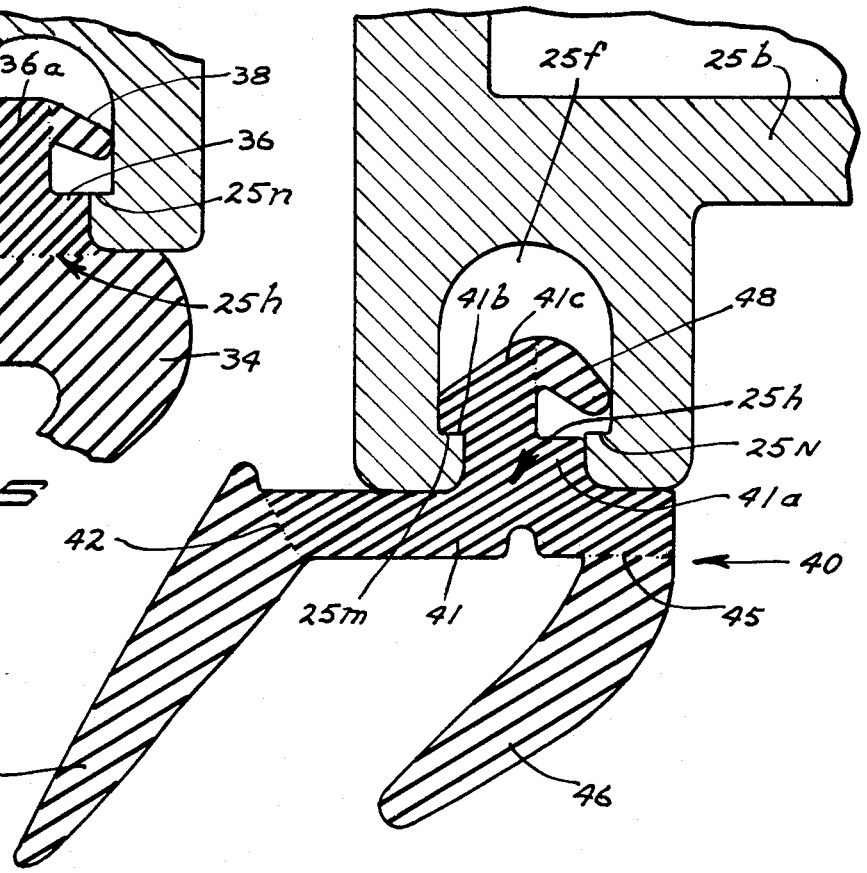
FIG. 5

GLAZING BEAD STRUCTURE

BACKGROUND OF THE INVENTION

1. Field of Invention

This invention relates to resilient rubber-like non-stretchable glazing bead for use in sealing a window pane within a window frame of a commercial building wall frame structure.

2. Description of the Prior Art

Glazing bead structures are in common use and are formed of resilient or rubber-like extruded plastic or plastic composition materials which tend to stretch under stress in being drawn longitudinally into a retaining bead slot or socket and subsequently tend to draw together or shrink, as it were, to original length. This shrinkage causes a withdrawal of the glazing bead from each end of the slot requiring an overlength to be supplied at installation and a waiting time for the shrinkage to occur. Such glazing beads are generally installed prior to the installation of a window pane and have a common tendency to be dislodged out of their respective retention slots or sockets by the frictional engagement therewith of a window pane being installed into a channel of a window frame by being edged into the channel and then having frictional engagement with the glazing bead.

SUMMARY OF THE INVENTION

It is desirable to have a glazing bead as a weather seal in elongated strip form in connection with the installation of a window pane in a commercial type window frame and particularly where the wall of a building is a frame structure comprising a multiplicity of window frames. It is desirable to have such a glazing bead which may be installed prior to the installation of the window pane and which will not become dislodged in the process of the installation of a window pane.

It is a particular object of the invention herein, therefore, to provide a non-stretchable type glazing bead in connection with commercial type window frames such that the bead may readily be pulled longitudinally into an accommodating longitudinal slot or socket of a window frame.

It is another object of the invention herein in connection with a window frame to provide a glazing bead of the character above indicated which upon being installed does not become dislodged by the frictional engagement therewith resulting from the subsequent installation of a window pane.

It is also an object of the invention herein to provide a glazing bead for commercial type store or building windows or glass curtain type walls embodying window frames wherein the glazing bead may be installed with equal facility by being drawn lengthwise into a glazing bead slot or by being pressed laterally for insertion into such a slot, in either instance the bead, once installed, effectively resisting dislodgement upon the subsequent installation of window panes.

More specifically, it is an object of the invention herein to provide a commercial type glazing bead structure of the character above described wherein by a dual durometer extrusion, the external sealing portion of the bead structure is yielding to have effective sealing engagement with the adjacent window pane and whereas the bead portion of the structure which is disposed into the glazing bead retaining slot or socket of a window frame is sufficiently rigid to readily slide into or through said slot and in addition is particularly adapted to have secure holding engagement within the slot.

These and other objects and advantages of the invention will be set forth in the following description made in connection with the accompanying drawings in which like reference characters refer to similar parts throughout the several views.

BRIEF DESCRIPTION OF THE DRAWINGS

FIG. 4 is a detail of structure on an enlarged scale;

FIG. 5 is a view similar to FIG. 4 showing a modification; and

FIG. 6 is a view similar to FIG. 4 showing another modification.

DESCRIPTION OF A PREFERRED EMBODIMENT

The invention herein relates to improvement in the construction of a glazing or insulating bead to seal a window pane which has its perimeter or edge portions disposed into the channel openings of a metal frame. This type of window pane insulation is common in the construction of a building having what is referred to as a curtain wall or a glass curtain wall which is a frame wall structure embodying a multiplicity of window frames.

Figure 1:
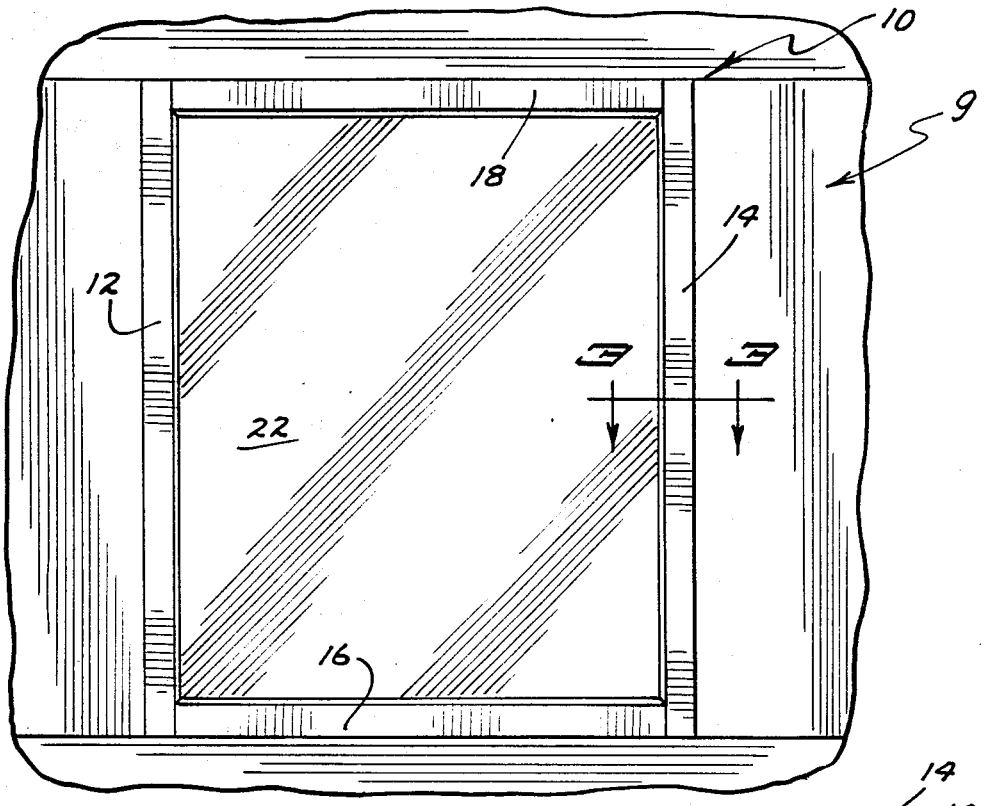
FIG. 1 is a view in front elevation.
Figure 2:
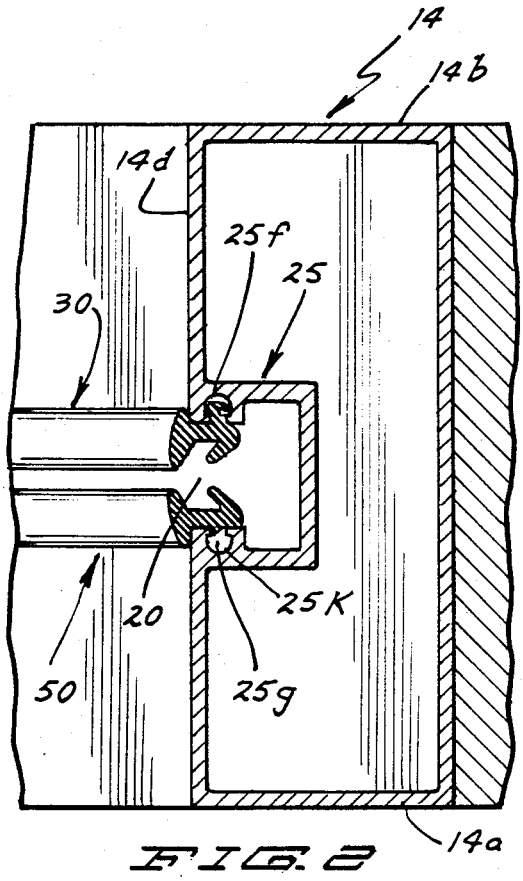
FIG. 2 is a view in vertical section of a detail of structure.

A conventional individual window frame 10 of a curtain wall structure 9 is shown in FIG. 1, said window frame having side members 12 and 14, a bottom member or sill 16 and a top member or header 18. Disposed therein is a window pane 22.

Figure 3:
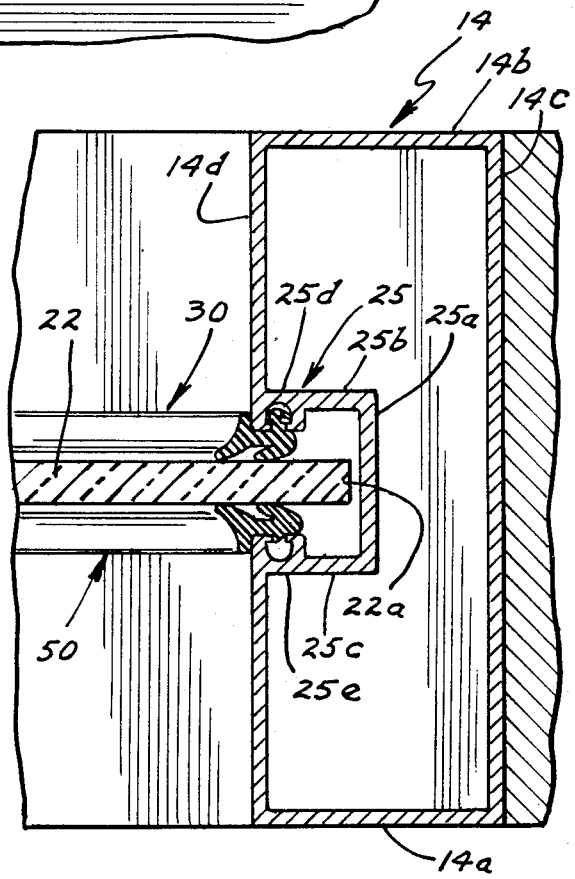
FIG. 3 is a view in vertical section taken on line 3—3 of F 1 as indicated.

A horizontal section of the side member 14 of said window frame is shown in FIG. 3, the description of which will be representative of the remainder of the like cross-sectional structure of each of the said other members of said frame. Said frame member 14 in said sectional view is shown having end walls 14a and 14*b*, an outer or exterior side wall 14*c* and an inner or interior side wall 14*d*.

Said wall 14*d* has a longitudinal slot 20 therein which will have disposed therein the perimeter or edge portion 22*a* of said window pane 22 (FIG. 3).

Said slot 20 is boxed in or enclosed longitudinally thereof on the interior of said member 14 and more particularly at the inner side of said wall 14*d* by an interior channel member 25 integral therewith. Said channel member has an inner wall 25*a* and end walls 25*b* and 25*c* which are integral with said wall 14*d* *at each side of said slot 20.*

Said walls 25*b* and 25*c* have taken facing abutments 25*d* and 25*e* inwardly of said wall 14*d* at each side of said slot, as shown.

Said abutments are of a size to have longitudinal sockets 25*f* and 25*g* extend the length thereof. Said sockets are intended to retain therein window pane sealing members. Said sockets have opposed or facing slits or openings 25*h* and 25*k*, said slits or openings forming restricted openings with respect to the widths of their respective sockets. Said sockets in cross section are here shown to be substantially elliptical in cross-section as in FIG. 4. It will be noted that the slit or opening 25*h* has shoulders 25*m* and 25*n* at each side thereof.

Described now will be the glazing bead structure which comprises the invention herein and the same will be described in connection with the glazing bead socket 25*f* and its opening 25*h*.

As a preliminary explanation, it is a general practice to first install a glazing bead or sealing member in the bead slot which will be at the exterior or out-of-door side of the window. The window pane is then installed by being edged or pushed into the channels of a frame segment. In this installation, the window pane is edged past the installed glazing bead and thus has frictional engagement with it. It is at this time that the frictional engagement of the window pane with the window pane sealing portions of the glazing bead which causes the glazing bead to become dislodged from its retaining socket.

When the pane has been installed, then another sealing member which is pressure held is wedged into the remaining space of the slot 20 at the interior or indoor side of the pane. The invention herein relates only to the installation of the glazing bead at the exterior side of the window frame slot 20 prior to the installation of the window pane.

In FIG. 4, a cross sectional view of a glazing or insulating bead 30 is shown. The particular construction of a preferred embodiment of the glazing bead herein illustrating the improvement therein is well shown in said cross sectional view.

Said glazing bead is formed for the most part of a thermoplastic elastomer which has rubber characteristics in being very flexible and yielding and in forming a good sealing engagement with a window pane. The locking structure of the bead as will be described has other characteristics.

Said glazing bead 30 is presented in one embodiment in the configuration here shown which comprises a central body portion 31 somewhat rectangular in cross section having a lateral projection 32 thereof from which an ear-like flap portion 33 extends upwardly as at 33*a* to hug the adjacent portion of wall 14*d* and extends downwardly at an outward slant as at 33*b*. Another ear-like flap portion 34 from the opposite end of said body portion projects downwardly as at 34*a* and is substantially parallel to said portion 33 having therebetween a U-shaped space 35, the ends of both projecting portions 33*b* and 34*a* extend to a common plane and both of said flap portions will bear in sealing engagement against the adjacent exterior surface of the pane 22.

Extending upwardly or laterally of said body portion 31 is a neck portion 36 which conforms to and fits nicely into the slit or opening 25*h*. This neck portion is formed of a rigid polypropylene plastic material which has a fairly easy sliding friction free characteristic. The glazing bead is extruded to have the dual durometer structure of the body portion 31 taken with the neck portion 36.

Said neck portion has an upwardly extending portion 36*a* which is of a lesser width and is offset in the direction of and adjacent to the wall 14*d* to form a shoulder 36*b* which seats upon the shoulder 25*m* as shown.

Extending oppositely from the upper portion of the projection 36*a* oppositely of the shoulder portion is a flexible flap 38 which extends to the adjacent wall of said socket 25*f*.

In operation, the glazing bead is installed preferably by being pulled into and through the socket 25*f* and slit 25*h* or by being pushed laterally thereinto for the full length of the socket. Said rigid neck portion makes it possible to push or pull said glazing bead strip into position without causing it to stretch or squeeze up and is sufficiently yielding to permit said strip to be pushed laterally through the slit 25*h* into the socket 25*f*, if it is desired to do so.

In viewing the structure of FIG. 3 with the glazing bead 30 in position, a window pane will be installed by having a perimeter portion thereof edged into slot 20 in the frame member 14*d* from left to right as viewed. The sealing member 50 will be afterwards installed by being forcibly wedged into the position shown.

Viewing FIG. 3 with FIG. 4, it is important to note that as pressure is applied to the ends of said flap portions 33*b* and 34*a* by edging the window pane thereby through the slot 20 that the torque thus applied against said flap portions causes the rigid neck portion 36 to have the tendency to cock at its offset portion 36*b* and engage upon the shoulder 25*m* and the portion 36*a* abuts the adjacent wall of the socket 25*f*. Thus the rigid nature of said neck portion 36 is caused by such displacement to become securely lodged in position against said shoulder 25*m*. The overhang of the offset 36*b* upon the shoulder 25*m* results in a locking engagement.

In the course of installing a window pane, in the event of causing a torque oppositely that above described, the flap 38 would be caused to ball up against the adjacent wall of said socket 25*f* and if the neck portion 36 were to be tilted sufficiently, said flap would rest upon the shoulder 25*n* and cause the entire neck portion to become so lodged as to prevent the withdrawal of said member 30 from said socket 25*f*.

Said glazing bead has proved to be very successful in use and has been an important factor in speeding up the installation of window panes into a window frame type of wall structure. The flexible portions 33*b* and 34*a* engaging a window pane form a very effective weather seal.

Referring to FIG. 5, a modification is shown to be present in the glazing bead or insulation strip 40. Elements of this structure above described bear like reference numerals.

The glazing bead 40 has a vertical section a fairly rectangular body portion 41 which underlies the slot 25*f* and extends laterally of the wall 14*d* as at its one end 42 and has a downwardly outwardly extending flap 43 of somewhat greater length than said flap 33. A second flap 46 extends from the inner or opposite end of said body portion as indicated at 45 and is tapered and curved to be substantially in a parallel relation with said first flap 43.

Said body portion 41 extends upwardly to have a portion 41*a* thereof conform to the slot opening 25*h* and extend upwardly into said bore 25*f* to have a portion 41*b* offset to overlie the shoulder 25*m* and a portion 41*c* thereof extends further upwardly in engagement with the adjacent side of said socket 25*f*.

Projecting laterally downwardly from said portion 41*c* is a flexible flap 48 which extends to engage the adjacent wall of said bore 25*f*.

The body portion 41 and its extended portions 41*a*, 41*b* and 41*c* are formed of the fairly rigid polypropylene plastic material previously described. The weather seal members 43 and 46 and the flap 48 are formed of a thermoplastic elastomer having rubber-like characteristics.

The modification 40 of said glazing bead is retained in its operating position in the manner as above described in connection with the embodiment of FIG. 4.

Thus said glazing bead in being extruded to have dual durometer characteristics provides a portion engaging and extending through the slot 25*h* and into the interior of the bore 25*f* to be sufficiently rigid to slide easily into and through said socket or be pressed laterally thereinto. The window pane engaging portions 43 and 46 provide very good weather sealing engagement.

Referring to FIG. 6, a modification is shown of the embodiment of the structure of FIG. 4 in which like reference numerals indicate like structure.

The modification relates to the rigid portion 36*b* shown in FIG. 4 which rests upon and extends vertically of the shoulder 25m and which in FIG. 6 is indicated by the reference numeral 37 and is shown to be of a flexible resilient plastic material.

Both the embodiments of FIG. 4 and FIG. 6 effectively resist dislodgment from their respective sockets. Said shoulder 25*m* effectively secures in place both the structures 36*b* and 37.

For purpose of illustration and as previously indicated, a wedge strip 50 is indicated at the interior side of the frame 10 in connection with the glazing bead bore 25*g*. As above described, the wedge strip 50, in a conventional manner, is installed as a seal member when the window pane has been positioned.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A glazing bead member secured within the socket of a window frame, comprising a window frame having channels to receive a window pane, a glazing bead having a body portion drawn through said channel to be partially disposed therein, a flexible projection of said body portion for a weather seal engagement with an adjacent window pane, said channel having a restricted neck opening forming a shoulder at each side thereof at each side of said channel, said body portion including an integral substantially rigid neck portion disposed into said restricted neck opening of said channel and extending thereinto, said neck portion having a rigid stepped offset projection overlying a shoulder of said neck opening at one side of said channel, said neck portion having a portion extending to the side of said channel opposite said one side of said channel, said projection overlying said shoulder being pivotal thereon, said bead upon being biased by a pane of glass being into said frame is caused to have said offset projection pivoted upon said shoulder restricted by said portion thereof engaging the opposed side of said channel securing said neck portion within said channel.

2. A glazing bead member disposed through a slit into a socket of a window frame and having a sealing engagement with an adjacent window pane, wherein the improvement in said glazing bead member comprises a socket of a window frame having a slit to receive a window pane, a shoulder at each side of said slit adjacent each side wall of said socket, a rigid neck portion of glazing bead extending through said slit, an extension of said neck portion extending into said socket, a lateral projection of said extension overlying one said shoulders adjacent one side wall of said socket, a lateral projection of said neck portion oppositely of said first mentioned extension engaging the side wall of said socket remote from said first mentioned wall thereof, and an outward projection of said glazing bead having weather seal engagement with a window pane.

3. The structure of claim 2 wherein said second mentioned lateral projection is flexible.

4. The structure of claim 2, wherein said first mentioned lateral projection is rigid.

* * * * *